US005303994A

United States Patent [19]

Elsholz

[11] Patent Number: 5,303,994

[45] Date of Patent: Apr. 19, 1994

[54] DRAWER INTERLOCK

[75] Inventor: Michael D. Elsholz, Grand Rapids, Mich.

[73] Assignee: Steelcase Inc., Grand Rapids, Mich.

[21] Appl. No.: 893,711

[22] Filed: Jun. 5, 1992

[51] Int. Cl.[5] ..... E05B 65/46; E05C 7/06

[52] U.S. Cl. ..... 312/221; 312/215; 312/217; 312/220; 312/222

[58] Field of Search ..... 312/220, 221, 215, 216, 312/217, 218, 219, 222

[56] References Cited

U.S. PATENT DOCUMENTS

| | | | |
|---|---|---|---|
| 3,188,160 | 6/1965 | Cornelius et al. | 312/220 |
| 3,900,236 | 8/1975 | Goulish et al. | 312/217 |
| 3,909,090 | 9/1975 | Breckner | 312/217 |
| 3,969,008 | 7/1976 | Pergler | 312/221 |
| 4,272,138 | 6/1981 | Stark | 312/221 |
| 4,298,236 | 11/1981 | Laroche | 312/215 |
| 4,355,851 | 10/1982 | Slusser et al. | 312/215 |
| 4,429,930 | 2/1984 | Blouin | 312/216 |
| 4,441,767 | 4/1984 | Stark | 312/216 |
| 4,447,098 | 5/1984 | Parker | 312/216 |
| 4,480,883 | 11/1984 | Young | 312/220 |
| 4,711,505 | 12/1987 | Lakso | 312/220 |
| 4,768,844 | 9/1988 | Ludwig | 312/221 |
| 4,770,476 | 9/1988 | Lakso | 312/220 |
| 4,772,078 | 9/1988 | Bowyer | 312/221 |
| 4,854,653 | 8/1989 | Lakso | 312/222 |
| 4,889,396 | 12/1989 | Mitchell | 312/221 |
| 4,936,640 | 6/1990 | Pratzer | 312/221 |
| 4,957,334 | 9/1990 | Lakso | 312/221 |
| 4,960,309 | 10/1990 | Scheerhorn | 312/221 |
| 4,993,784 | 12/1991 | Dana et al. | 312/221 |
| 5,040,858 | 8/1991 | Kruse et al. | 312/221 |
| 5,050,942 | 9/1991 | Frederick et al. | 312/221 |
| 5,056,876 | 10/1991 | Scheerhorn | 312/221 |
| 5,056,877 | 10/1991 | Westwinkel | 312/221 |
| 5,074,627 | 4/1991 | Broeders | 312/221 |
| 5,102,210 | 4/1992 | Beals | 312/330 |

FOREIGN PATENT DOCUMENTS

| | | |
|---|---|---|
| 71248 | 7/1942 | Czechoslovakia . |
| 2740816 | 3/1979 | Fed. Rep. of Germany . |
| 3431386 | 3/1986 | Fed. Rep. of Germany . |
| 2173463 | 10/1973 | France . |
| 2365677 | 4/1978 | France . |
| 2514236 | 4/1983 | France . |
| 7604359 | 11/1977 | Netherlands . |
| 636160 | 5/1983 | Switzerland . |
| 1584777 | 2/1981 | United Kingdom . |

*Primary Examiner*—Joseph M. Gorski

*Attorney, Agent, or Firm*—Price, Heneveld, Cooper, DeWitt & Litton

[57] ABSTRACT

An interlock mechanism is provided for furniture units and the like of the type having two or more drawers, and functions to permit only one of the drawers to be opened at any given time, so as to avoid tipping, etc. The interlock includes a plurality of blocks slidably mounted in a vertical guide, with an actuator provided for each drawer. Each actuator comprises an arm having an upper portion pivotally mounted to the guide, and a lower portion with a notch shaped to selectively engage a pin on the associated drawer, such that closing and opening the drawer rotates the arm between corresponding unlocked and locked positions. Each actuator also includes a wedge pivotally connected with the lower portion of the arm, and slidably supported on the guide to reciprocate inbetween adjacent blocks when the associated drawer is opened, so as to lock closed all remaining drawers. Preferably, the vertical guide is formed in a unique, upright stiffener channel in the case, so as to maximize the lateral space available for the drawers.

30 Claims, 7 Drawing Sheets

DRAWER INTERLOCK

CROSS-REFERENCES TO RELATED APPLICATIONS

The present application is related to commonly assigned co-pending U.S. patent application Ser. No. 894,732, filed Jun. 5, 1992, entitled DRAWER CONSTRUCTION, which is hereby incorporated by reference.

BACKGROUND OF THE INVENTION

The present invention relates to furniture units of the type having two or more drawers, and in particular to a drawer interlock therefor.

Furniture units with drawers are generally well known in the art, and typically include multi-drawer vertical files, such as those used in freestanding file cabinets, pedestals for desks, worksurfaces, computer support units, and other similar furniture applications. When the drawers in such furniture units are to be used for relatively heavy articles, such as document storage, the unit is preferably provided with some type of drawer interlock mechanism that will permit only one of the drawers to be opened at any given time, so as to avoid vertical instability, tipping, etc. Such interlock mechanisms are normally provided as a safety feature in all freestanding vertical files.

Many different interlock systems have been developed in an attempt to economically, yet reliably interlock the drawers on vertical file cabinets. However, such prior mechanisms are typically not very flexible to adapt readily to different drawer configurations, and normally require substantial space within the interior of the file cabinet, which in turn reduces the maximum size and associated storage capacity of the drawers Another problem associated with prior drawer interlock mechanisms is that the actuators can be rather easily displaced inadvertently from their set locked or unlocked positions, such as by tilting the cabinet, impacting or vibrating the cabinet, and other similar causes, which can sometimes occur as a consequence of opening and closing the drawers. When an interlock actuator becomes misaligned, the open drawer cannot be completely closed, and the closed drawers cannot be opened. Hence, the misaligned actuator must be manually shifted back into its correct position before proper file drawer operations can be restored. This type of adjustment must sometimes be made by skilled maintenance personnel, particularly when the user is not familiar with the specific furniture unit.

SUMMARY OF THE INVENTION

One aspect of the present invention is to provide an interlock mechanism for furniture units and the like of the type having two or more drawers. The interlock includes a plurality of blocks slidably mounted in a vertical guide, with an actuator associated with each drawer. Each actuator comprises an arm having an upper portion thereof pivotally mounted to the guide, and a lower portion thereof with a notch shaped to selectively engage a pin on the associated drawer, such that closing and opening the drawer rotates the arm between corresponding unlocked and locked positions. Each actuator also includes a wedge pivotally connected with the lower portion of the arm, and slidably supported on the guide to reciprocate inbetween adjacent blocks when the associated drawer is opened to lock closed all remaining drawers.

Another aspect of the present invention is to provide a furniture unit comprising a case having an exterior skin and at least one uniquely shaped, vertically extending stiffener channel connected therewith to define a guide slot therebetween. First and second drawers are slidably mounted in the case for horizontal movement between closed and opened positions, and include associated actuator pins positioned adjacent the guide slot when the drawers are in their closed position. A plurality of blocking elements are slidably mounted in the guide slot for vertical translation therein. Each drawer includes an actuator, having an arm pivotally connected with the guide, and a notch configured to selectively receive therein the actuator pin of an associated one of the drawers Each actuator also includes a wedge pivotally connected with a lower portion of the arm, and slidably supported on the guide to reciprocate inbetween adjacent blocks when the associated drawer is opened to lock closed all remaining drawers.

The principal objects of the present invention are to provide a drawer interlock which is extremely reliable, and is also flexible to readily adapt the same for use in conjunction with a wide variety of different drawer configurations. The drawer interlock includes actuators with pivoting arms and sliding wedges, which together positively prevent more than one of the drawers from being opened at a time. Cam positioners are provided on the actuators, and serve to help retain the same in their set locked and unlocked positions, and thereby prevent inadvertent misalignment with its associated drawer. The interlock includes vertically stacked blocks that are preferably slidably retained in a specially shaped upright stiffener channel in the case, so as to maximize the lateral space available for the drawers The interlock is very durable, efficient in use, economical to manufacture, capable of a long operating life, and particularly well adapted for the proposed use. These and other advantages of the invention will be further understood and appreciated by those skilled in the art by reference to the following written specification, claims and appended drawings.

DETAILED DESCRIPTION OF THE PREFERRED EMBODIMENTS

Figure 1:
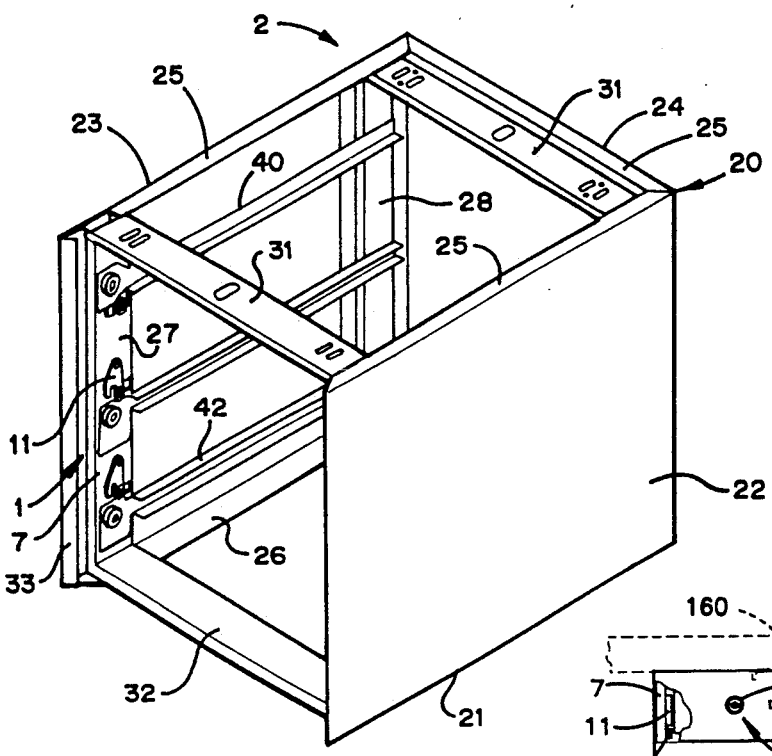
FIG. 1 is a perspective view of an interlock mechanism embodying the present invention, shown installed in a vertical file.
Figure 2:
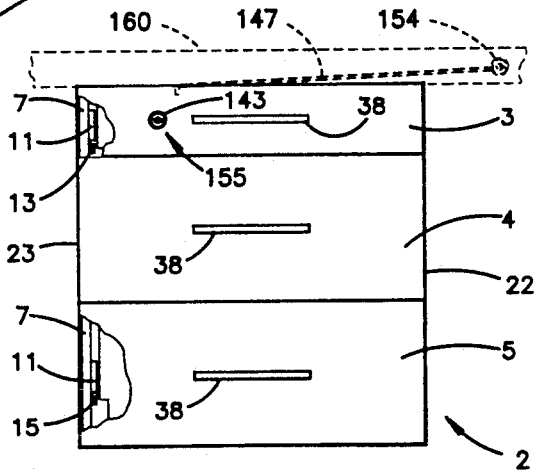
FIG. 2 is a front elevational view of the vertical file, with portions thereof broken away to reveal the interlock mechanism.
Figure 3:
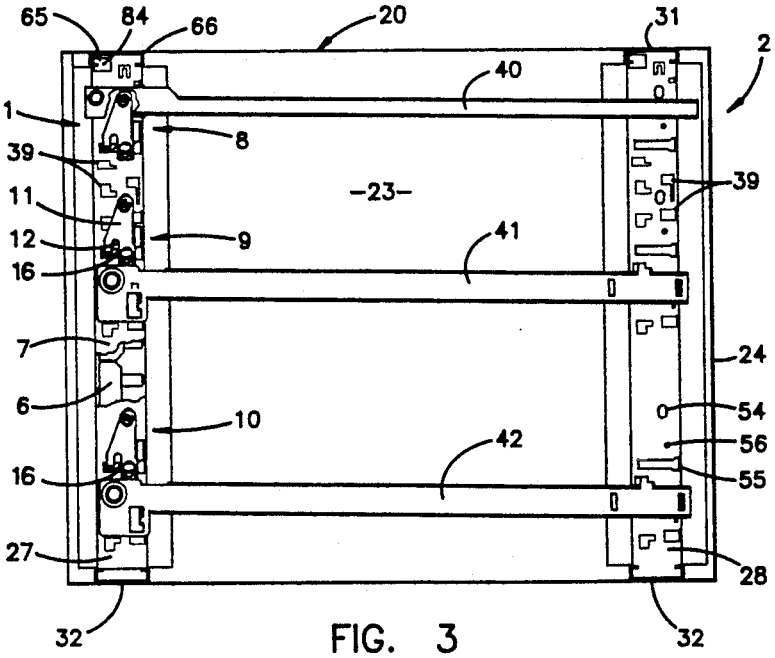
FIG. 3 is a vertical cross-sectional view of the vertical file cabinet

For purposes of description herein, the terms "upper", "lower", "right", "left", "rear", "front", "vertical", "horizontal", and derivatives thereof shall relate to the invention as oriented in FIGS. 1-3. However, it is to be understood that the invention may assume various alternative orientations and step sequences, except where expressly specified to the contrary It is also to be understood that the specific devices and process illustrated in the attached drawings, and described in the following specification are simply exemplary embodiments of the inventive concepts defined in the appended claims Hence, specific dimensions and other physical characteristics relating to the embodiments disclosed herein are not to be considered as limiting, unless the claims expressly state otherwise.

Figure 10:
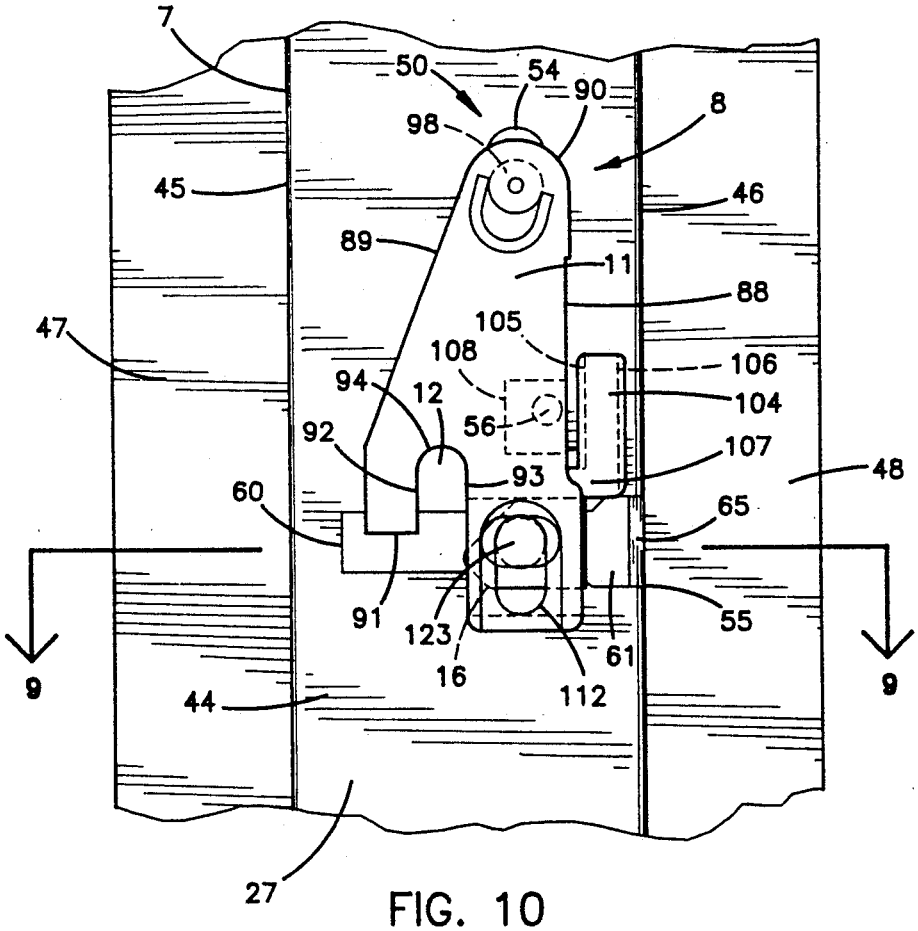
FIG. 10 is an enlarged, fragmentary, front elevational view of the actuator mounted on the guide, shown in an unlocked position when the drawer is closed.
Figure 12:
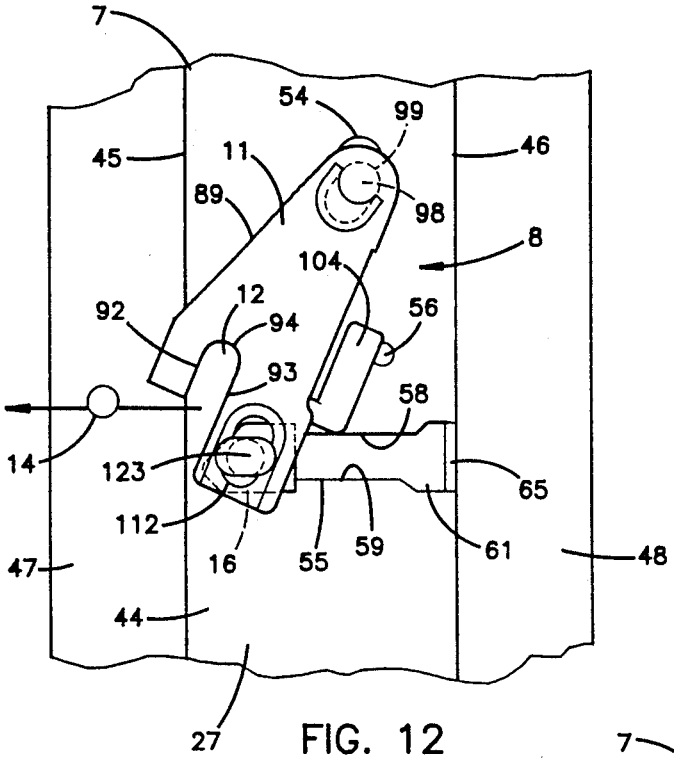
FIG. 12 is an enlarged, fragmentary, front elevational view of the actuator mounted on the guide, shown in a locked position when the drawer is opened
Figure 11:
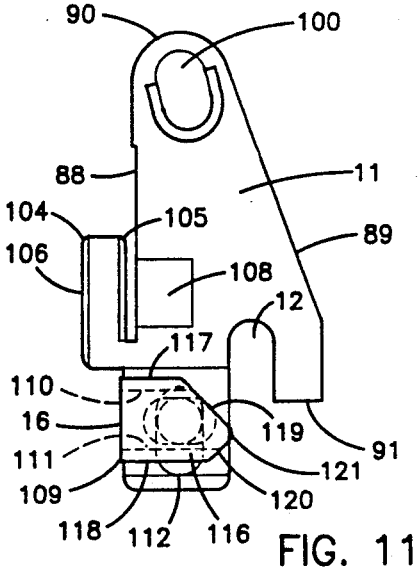
FIG. 11 is an enlarged, rear elevational view of the actuator.

The reference numeral 1 (FIGS. 1-3), generally designates an interlock mechanism embodying the present invention. Interlock mechanism 1 is particularly adapted for use in conjunction with furniture units and the like of the type having two or more horizontally shifting drawers, such as the illustrated vertical file 2, having three, vertically arranged drawers 3-5. Interlock mechanism 1 functions to permit only one of the drawers 3-5 to be opened at any given time, so as to avoid vertical instability, tipping, etc. The illustrated interlock mechanism 1 includes a plurality of blocks 6 slidably mounted in a vertical guide 7, with three actuators 8-10 associated with drawers 3-5, respectively. Each of the actuators 8-10 comprises an arm 11 having an upper portion pivotally mounted to the guide 7, and a lower portion with a notch 12 shaped to selectively engage an associated one of three actuator pins 13-15 on drawers 3-5, such that the closing and opening of drawers 3-5 rotates the associated arm 11 between corresponding unlocked and locked positions, as shown in FIGS. 10 and 12, respectively Each of the actuators 8-10 also includes a wedge 16 pivotally mounted on the lower portion of arm 11, and slidably supported on guide 7 to reciprocate inbetween adjacent blocks 6 when the associated one of the drawers 3-5 is opened, so as to lock closed all remaining drawers. Preferably, the vertical guide 7 is formed by a specially configured upright stiffener channel, and is positioned in the vertical file 2 in a manner, which maximizes the lateral space available for drawers 3-5.

The illustrated vertical file 2 (FIGS. 1-3) includes a case 20 in which drawers 3-5 are slidably mounted to reciprocate horizontally between fully opened and fully closed positions. Case 20 has an exterior skin 21 formed from a sheet metal blank or the like, comprising opposite side walls 22 and 23, and a rear wall 24, which are integrally interconnected in a fashion which imparts a rigid box-like configuration to case 20. Case walls 22-24 each include upper and lower flanges 25 and 26, which extend inwardly from the upper and lower edges thereof. Two pairs of substantially identical, specially configured, vertical stiffeners 27 and 28 are fixedly attached to the interior sides of sidewalls 22 and 23, opposite adjacent ends thereof, by means such as spot welding, adhesives, or the like. Two pairs of horizontal stiffeners 31 and 32 extend laterally across the upper and lower portions of case 20, and are connected to the upper and lower ends of oppositely facing vertical stiffeners 27 and 28, as well as to flanges 25 and 26, which together serve to rigidify case 20. The forward edges of sidewalls 22 and 23 are beveled inwardly to define associated front flanges 33, behind which forward portions of the front vertical stiffeners 27 are received in the manner described below.

Figure 17:
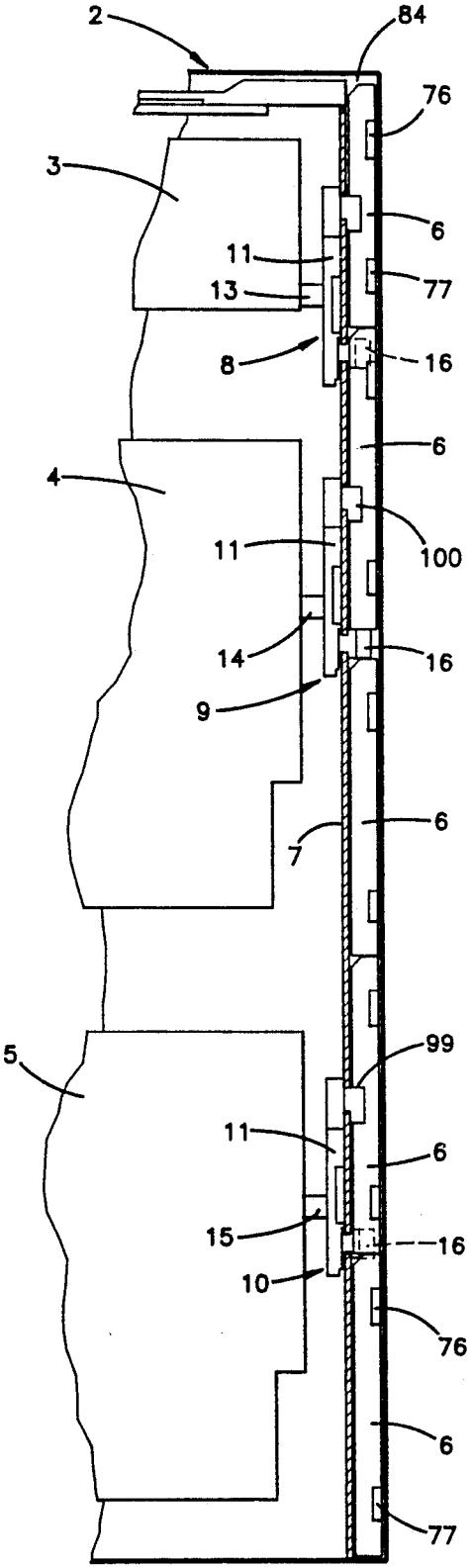
FIG. 17 is a partially schematic, front elevational view of the vertical file, shown with the center drawer opened.
Figure 18:
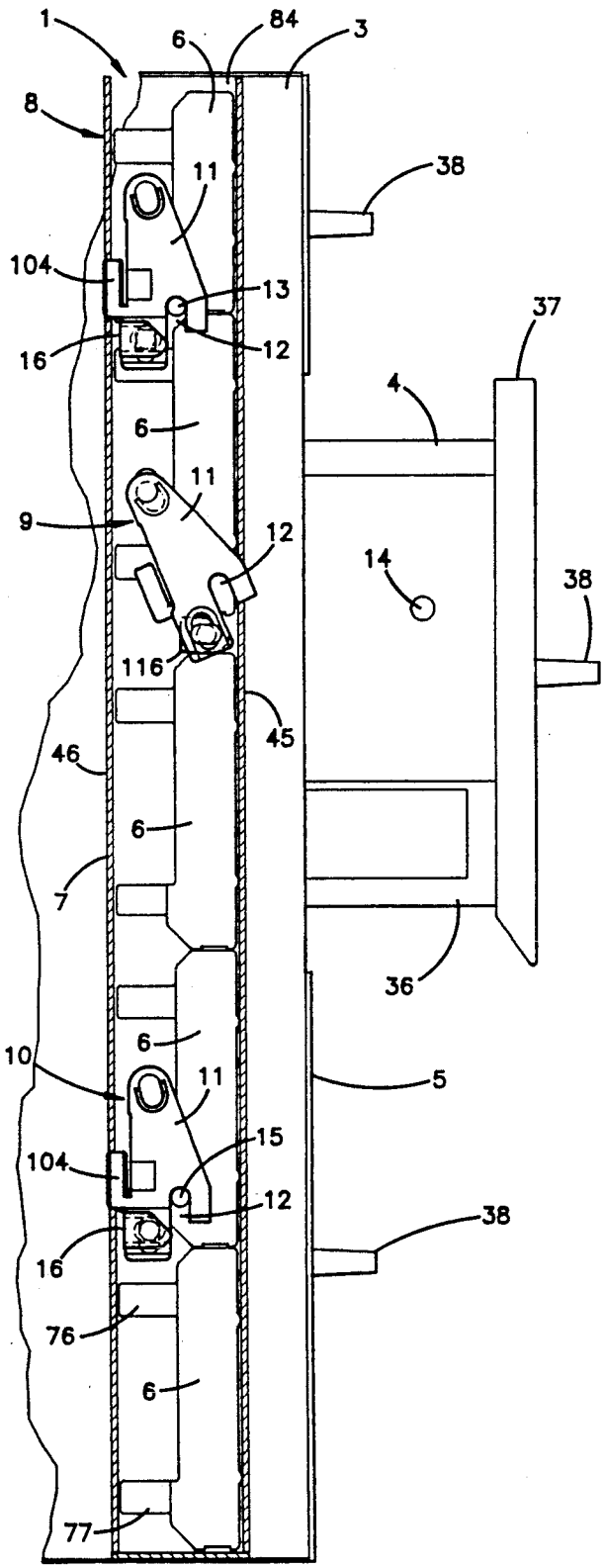
FIG. 18 is a partially schematic, side elevational view of the vertical file, shown with the center drawer opened.

Drawers 3-5 (FIGS. 2, 17 and 18) may have a conventional construction, comprising a rectangular, box-shape core assembly 36 (FIG. 18) on which a head 37 is mounted in the open forward end thereof, and includes a pull 38 to facilitate manually shifting drawers 3-5 between their fully closed and fully opened positions. Lock actuator pins 13-15 are located on the left hand side of each of the associated drawers 3-5, adjacent the forward portion thereof, and protrude laterally outwardly therefrom to engage the notch 12 in the associated one of the actuators 8-10. In the illustrated example, drawers 3-5 each have a unique modular and convertible construction, as disclosed in commonly assigned, co-pending U.S. patent application Ser. No. 894,732, filed Jun. 5, 1992, entitled DRAWER CONSTRUCTION, which is incorporated herein by reference. However, it is to be understood that the present interlock mechanism 1 can also be used in conjunction with other types of drawer constructions.

The vertical stiffeners 27 and 28 (FIG. 3) include a series of slots 39 through the outer flanges thereof in which drawer suspension units 40-42 are detachably mounted to slidingly support associated drawers 3-5, respectively. In the illustrated example, drawer suspensions 40-42 have a generally conventional construction, and are located to position drawer actuators pin 13-15 in line with their respective actuators 8-10.

In the example shown in FIG. 1, the left-hand, front vertical stiffener 27 in case 20 defines guide 7, which as described in greater detail hereinafter, is specially configured to minimize the lateral space required for interlock mechanism 1, thereby maximizing the lateral space available for drawers 3-5 in such a manner that both $8\frac{1}{2}\times11$ and A4 sized drawers can be housed within the same case 20, without increasing the width of case 20 from its standardized $8\frac{1}{2}\times11$ size. The illustrated guide 7 (FIGS. 4-7) comprises a rigid, elongate channel, having a generally U-shaped transverse cross-sectional configuration, including a central web 44 (FIG. 6), front and rear flanges 45 and 46 extending laterally along the opposite edges of web 44, and wing flanges 47 and 48 extending horizontally from front and rear flanges 45 and 46 in a fore-to-aft direction. As best illustrated in FIG. 6, wing flanges 47 and 48 are positioned adjacent to the interior surface of the left hand sidewall 22 adjacent forward flange 33, and are fixedly attached thereto by means such as spot welding or the like. Guide channel 7 and sidewall 22 together define a vertically extending way or space 49 therebetween, having a rectangular transverse cross-sectional shape in which a vertical stack of blocks 6 are closely, yet slidably received.

Figure 6:
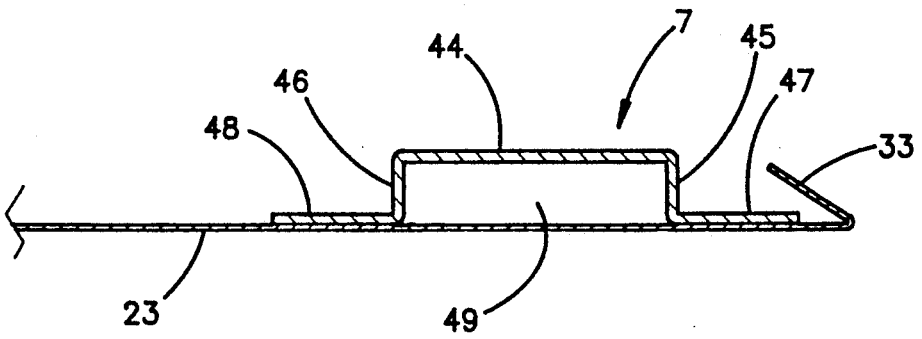
FIG. 6 is a horizontal cross-sectional view of the guide.
Figure 7:
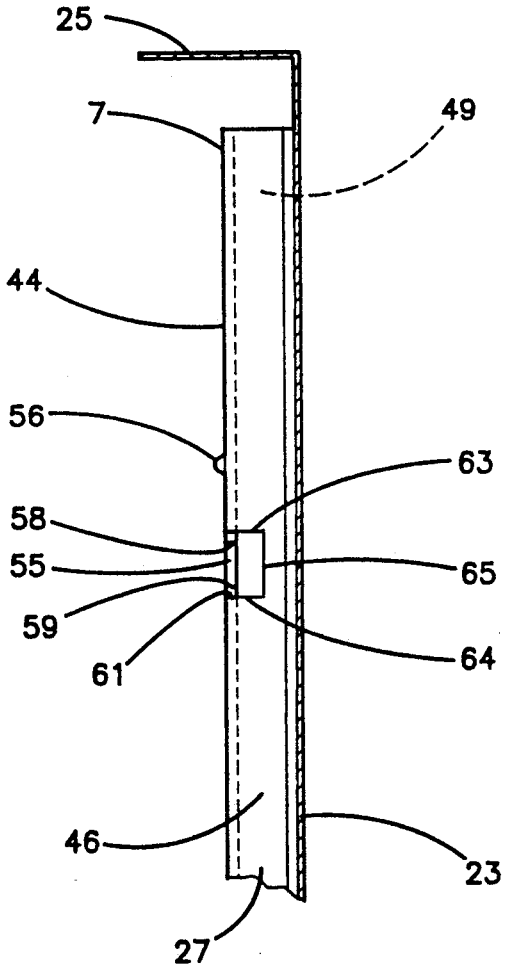
FIG. 7 is a fragmentary, rear end elevational view of the guide.
Figure 8:
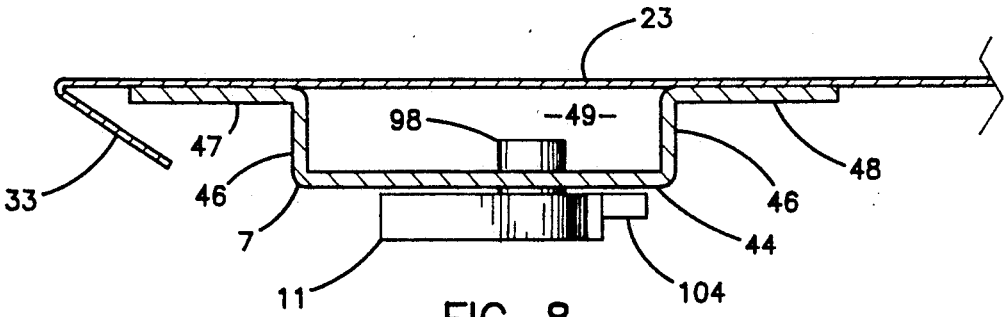
FIG. 8 is an enlarged, fragmentary top plan view of an actuator portion of the interlock mechanism mounted on the guide.
Figure 9:
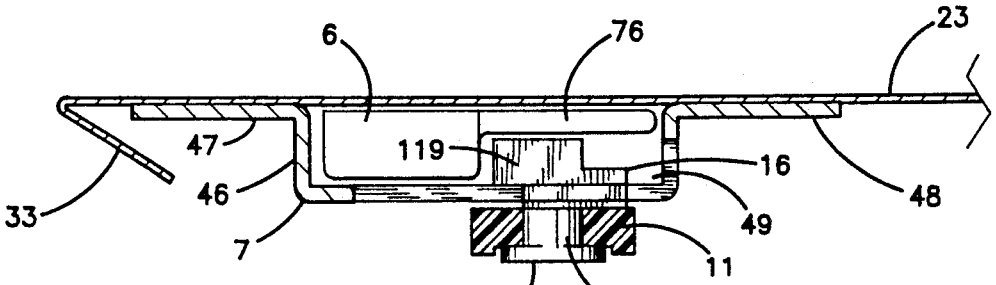
FIG. 9 is a horizontal, cross-sectional view of the actuator mounted on the guide, taken along the line IX—IX, FIG. 10.

Guide channel 7 (FIGS. 4–7) has a plurality of sets of openings which define separate actuator mounting stations 50 that are spaced regularly along the length of guide channel 7 in accordance with the incremental depth of drawers 3–5, such that interlock mechanism 1 can be readily configured and reconfigured to accommodate different depth drawers, as explained in greater detail hereinafter. With reference to FIG. 5, each actuator mounting station 50 includes a pin slot 54, a slide window 55, and a rounded protrusion 56, each of which is positioned at least in part in the web 44 of guide 7 Pin slot 54 is vertically elongated, and includes semi-circular end edges 57. Pin slot 54 extends through web 44, and is positioned with its major axis located slightly rearwardly from the center line of web 44. Slide window 55 is generally key-shaped, and is positioned vertically below its associated pin slot 54. The illustrated slide window 55 is defined by generally parallel upper and lower edges 58 and 59, and a forward end edge 60. End edge 60 is positioned slightly rearwardly from the front flange 45 of guide channel 7, while upper and lower edges 58 and 59 merge into an enlarged guide portion 61 of slide window 55, which extends laterally outwardly into the rear flange 46 of guide 7, as defined by associated edges 63-64 (FIG. 7). As described in greater detail hereinafter, the guide portion 61 of slide window 55 is shaped to laterally receive an associated wedge 16 therein Rounded protrusion 56 extends laterally outwardly from the exterior side of web 44, has a generally semi-spherical shape, and is positioned horizontally on web 44 slightly rearwardly from the center line of pin slot 54. In the illustrated example, actuator mounting stations 50 are located approximately six inches apart along the length of guide 7.

Guide channel 7 has upper and lower ends 66 and 67 received within horizontal stiffeners 31 and 32 and extends continuously therebetween The upper end 66 (FIGS. 3–5) of guide channel 7 includes a rectangularly-shaped window 65 through web portion 44 into which a sliding lock actuator 130 (FIGS. 14–16) is received in the manner described in greater detail hereinafter.

The illustrated blocks 6 (FIG. 4) have an incremental length corresponding to the incremental depth of drawers 3–5, which in one working embodiment of the present invention is approximately two to three inches. Each block 6 has an irregular hexagon side elevational shape, comprising a front edge 70, top and bottom edges 71 and 72, inclined ramp edges 73 and 74 and rear edge 75. A pair of fingers 76 and 77 extend rearwardly from rear edge 75, and serve to expand the effective width of block 6, so as to be closely, yet slidably received within guide 7. The provision of finger 76 and 77 permits the mounting of drawer suspension units 40–42 in the slots 39 in web 44 of guide 7, without interfering with the vertical sliding motion of blocks 6.

Figure 4:
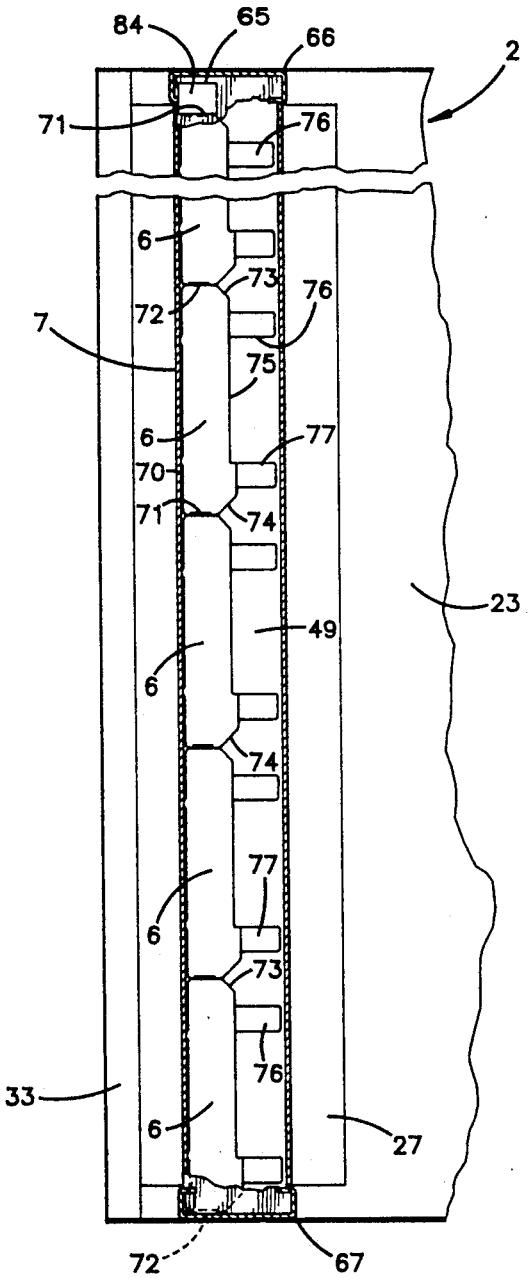
FIG. 4 is a fragmentary, vertical cross-sectional view of the vertical file, with portions thereof broken away to show vertically stacked blocks slidably supported in a mating guide.
Figure 5:
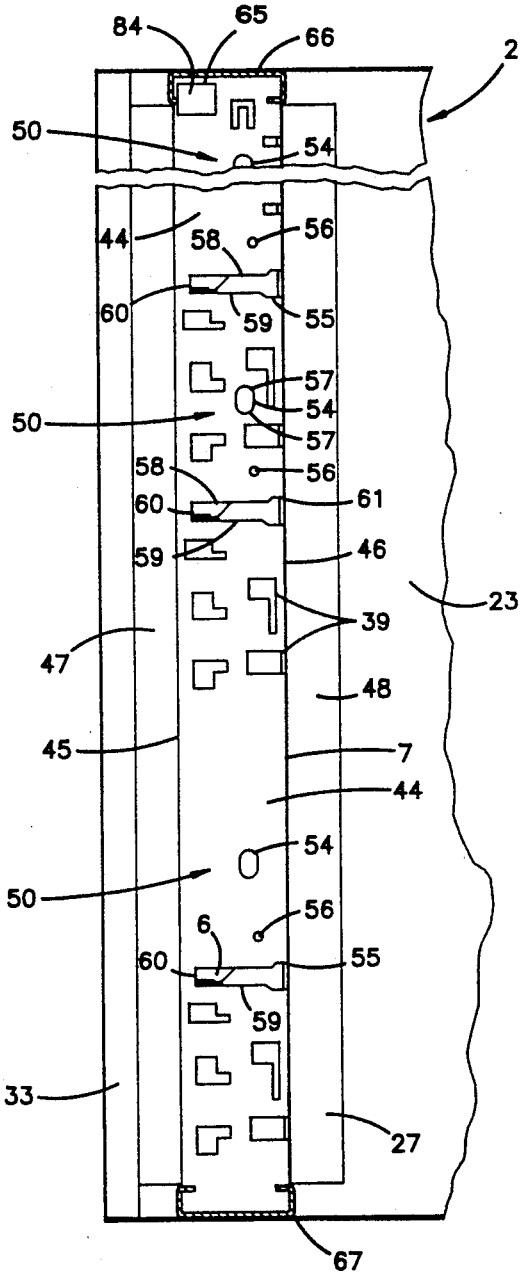
FIG. 5 is a fragmentary, side, elevational view of the guide.

As best illustrated in FIGS. 4 and 5, blocks 6 are arranged in a vertically, stacked arrangement, retained within the interior way 49 of guide 7. Blocks 6 and guide 7 are mutually sized so that when the bottom edge 72 of the lowermost block 6 is flush with the lower end 67 edge of guide 7, the top edge 71 of the uppermost block 6 is spaced apart from the upper end 66 of guide channel 7 to define a locking space 84 therebetween for purposes to be described in greater detail hereinafter.

With reference to FIGS. 8–13, interlock actuators 8–10 have a substantially identical construction, and can be located in any one of the actuator mounting stations 50. Hence, for ease of description herein, reference shall be had only to actuator 8, it being understood that all other actuators, including actuators 9 and 10 are substantially identical. The arm portion 11 of actuator 8 is in the nature of a cam, having a generally triangular side elevational configuration defined by a rear edge 88, a front edge 89, a rounded upper edge 90, and a notched lower edge 91. The notch 12 in actuator 8 extends in a generally parallel fashion with rear edge 88, and is defined by parallel side edges 92 and 93, and arcuate end edge 94.

A mounting pin 98 protrudes from the rear surface of actuator cam 11, and is shaped to be received within an associated one of the pin slots 54 in guide 7. The illustrated mounting pin 98 includes a generally cylindrically shaped shank 99 having a diameter slightly smaller than the width of pin slot 54, and an enlarged obround head 100, which is shaped slightly smaller than the plan configuration of pin slot 54, so as to be closely received therein. The central axis of head 100, is positioned eccentrically with respect to the central axis of shank 99, such that when mounting pin 98 is inserted into an associated pin slot 54, the cam 11 is shifted downwardly within pin slot 54, and the outwardly protruding head 100 on mounting pin 98 extends over the interior side of guide web 44 to detachably lock cam 11 on guide 7 in a manner which permits cam 7 to smoothly pivot about shank 99 in a fore-to-aft direction.

Cam 11 (FIGS. 8–13) also includes a resilient positioner element in the form of a wing 104, which projects rearwardly from the rear edge 88 thereof. Wing 104 has a generally rectangular plan configuration, with its longitudinal axis oriented generally vertically, and includes beveled leading and trailing edges 105 and 106, respectively. Wing 104 has a relatively narrow neck 107 which connects the same with the rear edge 88 of cam 11, and is preferably integrally formed with cam 11 from a resilient material, such as plastic or the like, such that wing 104 is resiliently, laterally flexible with respect to cam 11, in the nature of a leaf spring or the like. Cam wing 104 is positioned to abuttingly engage an associated one of the rounded protrusions 56 on guide 7 in a manner which serves to retain the cam 11 in its set locked and unlocked positions, as described in greater detail hereinafter. A depression or recess 108 is provided on the rear surface of cam 11, and is shaped to receive rounded protrusion 56 therein when cam 11 is in the unlocked position, as illustrated in FIG. 10.

The lower portion of cam 11 (FIGS. 8–13) includes a longitudinally elongated aperture 112 therethrough in which an associated wedge 16 is rotatably mounted. The illustrated wedge 11 has a primary body portion 109 with upper and lower grooves 110 and 111 formed therein into which the upper and lower edges 58 and 59 of an associated slide window 55 are closely received to slidably mount wedge 16 for horizontal reciprocation therein. A block separator 116 extends rearwardly from the body portion 109 of wedge 16, and includes upper and lower edges 117 and 118, and angled forward edges 119 and 120, arranged in a dihedral configuration intersecting along a parting edge 121. The angled forward edges 119 and 120 of block separator 116 are shaped similar to the ramp edges 73 and 74 of blocks 6 for sliding engagement therebetween. A mounting pin 122 extends forwardly from block separator 116, and includes an enlarged head 123 sized to be closely received through the aperture 112 in cam 11 with a snap lock type of action. When block separator 116 is oriented in its horizontal operational position, the head 123 of mounting pin 122 is pivoted ninety degrees from its insertion position, so as to positively, yet pivotally interconnect block separator 116 with cam 11, without requiring any separate fasteners.

In operation, an actuator 8 is installed in each of the actuator mounting stations 50 associated with an associated drawer. In the illustrated example, actuators 8–10 are mounted adjacent drawers 3–5 respectively Each actuator is installed in its associated mounting station 50 in the following manner. The block separator 116 (FIGS. 8–13) is connected with the lower portion of cam 11 by inserting mounting pin 122 through aperture 112, and rotating block separator 116 ninety degrees in the fashion described hereinabove. Block separator 116 is then inserted into the enlarged guide portion 61 slide window 55, between window edges 63–65. The grooves 110 and 111 on wedge body 109 are aligned with the upper and lower edges 58 and 59 of slide window 55, and wedge 16 is shifted forwardly to achieve sliding engagement therebetween, such that block separator 116 is captured within slide window 55, and can slidingly reciprocate in a horizontal direction freely therein.

Next, the mounting pin 98 at the upper portion of cam 11 is mounted in pin slot 54, by inserting head 100 therethrough, and shifting cam 11 slightly downwardly, so that the shank portion 99 of mounting pin 98 rests against the lower edge 57 of pin slot 54, as illustrated in FIG. 10. Both of the remaining actuators 9 and 10 are similarly mounted in their associated actuator mounting station 50 to correspond with center drawer 4 and bottom drawer 5, respectively.

When one of the drawers 3–5 is opened, the block separator 116 on the associate one of the actuators 8–10 is inserted into the vertical string of blocks 6, thereby separating the same, such that the remaining drawers are locked closed. For example, when the center drawer 4 is opened, as shown schematically in FIGS. 17 and 18, actuator pin 14 moves horizontally forwardly, thereby rotating the cam 11 of actuator 9 forwardly. The rotation of cam 11 causes block separator 116 to slide forwardly within slide window 55, such that the angled forward edges 119 and 120 of block separator 116 engage the adjacent ramp edges 73 and 74 of vertically adjacent blocks 6 to thereby vertically separate the same, and insert block separator 116 squarely inbetween the bottom edge 71 of the upper block 6, and the upper edge 72 of the lower block 6. In this locked position, the block separator 116 positively prevents vertical movement of each of the blocks 6 positioned below the block separator 116. Furthermore, the blocks 6 positioned above block separator 116 are shifted vertically so that their ramp surfaces 73 and 74 are out of horizontal alignment with separator blocks 116, such that the block separator 116 on the uppermost actuator 8 will engage the rear edge 75 of the associated block 6 in the event someone attempts to open top drawer 3. Hence, the insertion of block separator 116 into the vertical string of blocks 6 effectively locks closed all of the other drawers.

When center drawer 4 (FIGS. 4 and 5) is closed, actuator pin 14 engages the rearward edge 93 of notch 12, thereby pivoting the cam 11 of actuator 9 rearwardly to withdraw the block separator 116 from the vertical string of blocks 6, thereby permitting another one of the drawers to be opened.

Figure 13:
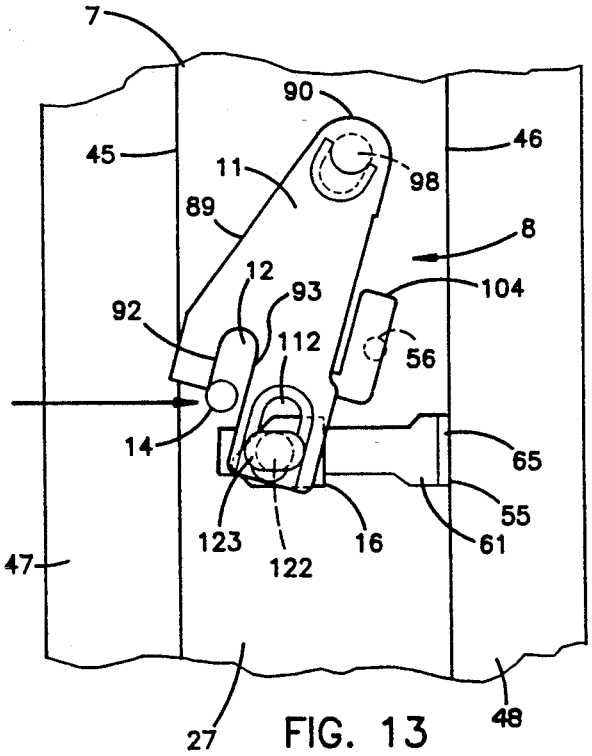
FIG. 13 is an enlarged, fragmentary, front elevational view of the actuator mounted on the guide, shown being shifted toward the unlocked position when the drawer is nearly fully closed.

As best illustrated in FIGS. 8–13, selective resilient engagement between cam wing 104 and rounded protrusion 56 serves to help ensure that cam 11 will not be inadvertently moved from its set locked and unlocked positions. When cam 11 is in the unlocked position, as shown in FIG. 10, rounded protrusion 56 is located within the recess 108 on the rear side of cam 11, such that there is no engagement therebetween, and cam 11 can pivot forwardly freely. As cam 11 is rotated forwardly, when the associated drawer is opened, the leading edge 105 of cam wing 104 engages rounded protrusion 56, and establishes resilient contact therebetween. When cam 11 is shifted to its fully locked position, as shown in FIG. 12, the trailing edge 106 of cam wing 104 passes over rounded protrusion 56 with a slight snapping type of action, and abuts the same, so as to prevent inadvertent movement of cam 11 back to the unlocked position. When the associated drawer is returned to its closed position, cam wing 104 again passes over rounded protrusion 56, as shown in FIG. 13. The contact between cam wing 104 and rounded protrusion 56, in conjunction with the geometry of actuator 8 causes arm 11 to shift upwardly, with mounting pin raising in pin slot 54. When the drawer is fully closed, cam wing 104 snaps over rounded protrusion 56, and cam 11 drops back down into its normal position, with shank 99 resting against the lower end edge 57 of pin slot 54, so as to assume the position illustrated in FIG. 10. This selected contact between cam wing 104 and rounded protrusion 56, and vertical shifting motion of cam 11, combine to help prevent cam 11 from pivoting inadvertently from either its locked or unlocked positions.

Figure 14:
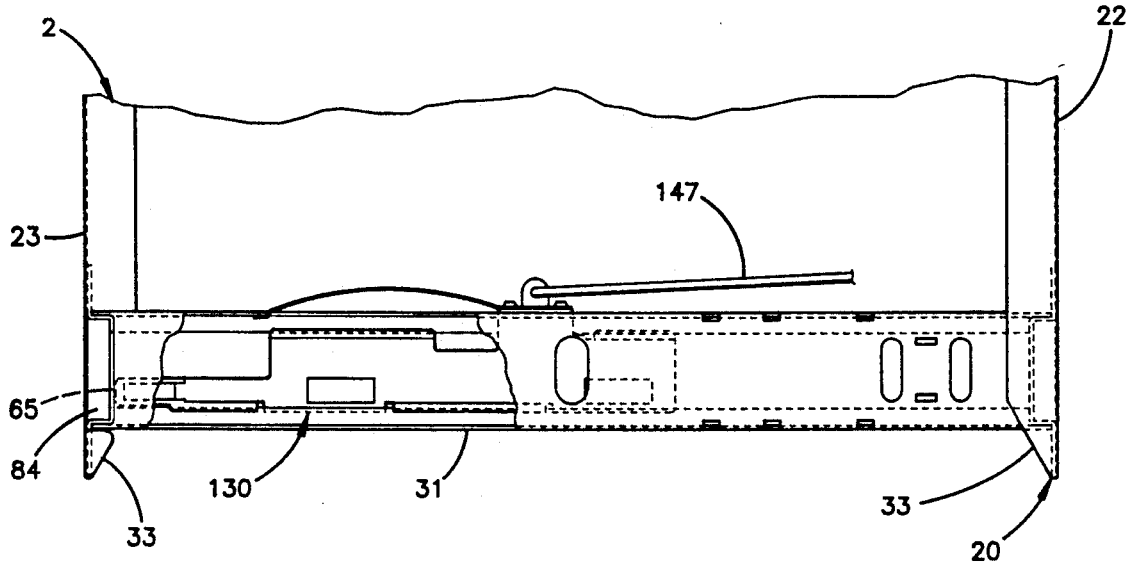
FIG. 14 is a fragmentary, top plan view of the vertical file, particularly showing a lock actuator.
Figure 15:
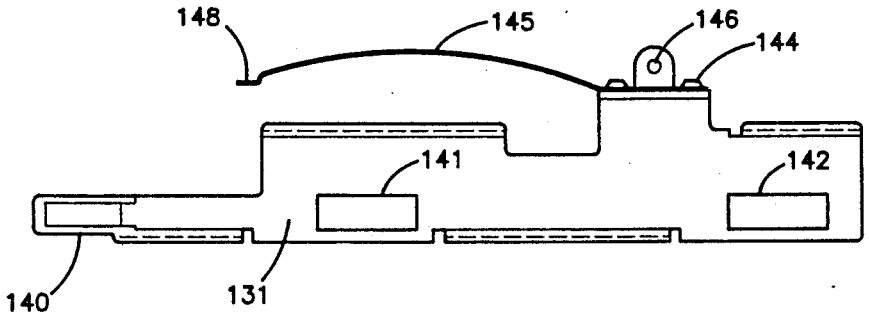
FIG. 15 is a top plan view of the lock actuator.
Figure 16:
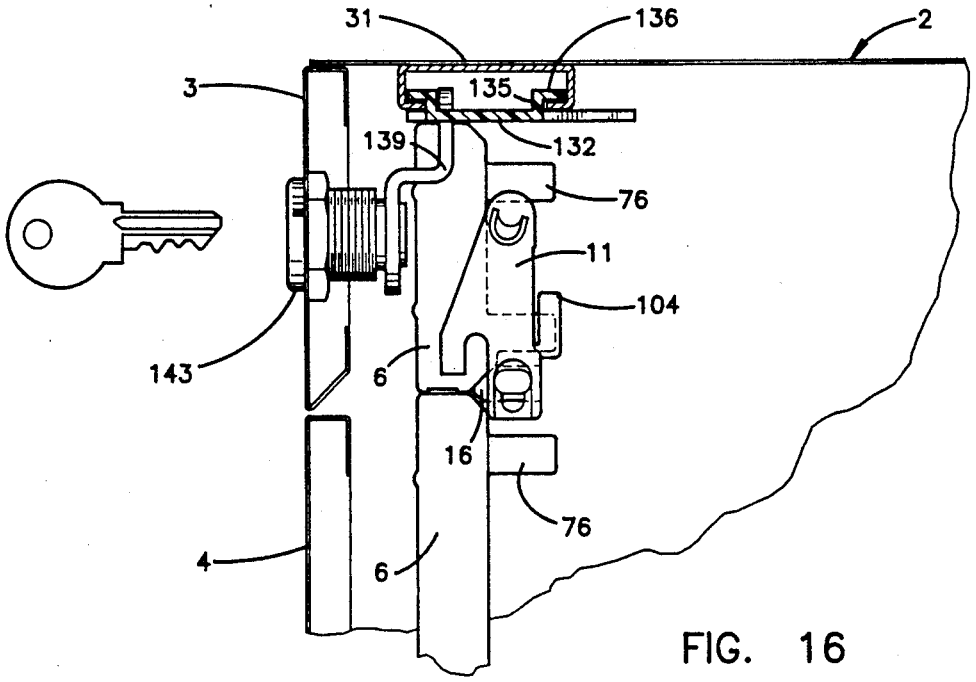
FIG. 16 is a fragmentary, vertical cross-sectional view of an upper portion of the vertical file, showing the lock actuator.

With reference to FIGS. 14–16, a lock actuator 130 is illustrated, which is particularly adapted for use in conjunction with interlock mechanism 1. Lock actuator 130 functions to simultaneously lock all drawers 3–5 in their fully closed position for security The illustrated lock actuator 130 comprises a slide 131 that is slidably supported in the forward, upper, horizontal case stiffener 31 for generally horizontal motion therein. Slide 131 has a generally U-shape transverse, cross-sectional shape, comprising a central web 132, with a pair of upstanding L-shaped sides, comprising flanges 135 and 136 shaped to snap within the interior of channel-shaped case stiffener 31. Slide 131 includes a finger 140 extending longitudinally from an outside end thereof, which is shaped to be closely received through the mating window 65 in guide 7, so as to substantially fill locking space 84. When finger 140 is inserted into locking space 84, engagement between the uppermost block 6 and slide finger 140 prevents any of the blocks 6 from being separated from one another a distance sufficient to permit a block separator 116 from being inserted between vertically adjacent blocks 6, so as to positively lock each of the drawers 3–5 in their fully closed position. Slide 131 includes two vertically oriented actuator windows 141 and 142 spaced longitudinally apart therein, which are shaped to receive therein an associated strike plate portion 139 (FIG. 16) of a key lock 143, as described in greater detail hereinafter. Slide 131 also includes a bracket portion 144 disposed along the rear edge of slide 141, and has one end of a leaf spring 145 attached thereto. Bracket 144 includes vertically extending control rod aperture 146 therein into which a control rod 147 from a center lock system (FIG. 1) can be inserted. The free end 148 of leaf spring 145 is formed to be closely received and detachably retained within an associated slot 149 in the rear flange of horizontal stiffener 31, as shown at FIG. 14. Leaf spring 145 is configured to resiliently urge slide 131 toward its normal, unlocked position.

Lock actuator 130 is designed to be used in conjunction with either a center lock arrangement 154, as shown by the broken lines in FIG. 2, or in a drawer front configuration 155, as shown by the solid lines in FIG. 2. When a drawer front configuration 155 is desired, key lock 143 is mounted in the head 37 of top drawer 3, such that associated strike arm 139 (FIG. 16) is received within one of the actuator windows 141 & 142 of slide 131, depending upon whether the lock is positioned in either a center or left side location on the drawer front. Rotation of the tumbler portion of key lock 143 rotates strike arm 139, thereby shifting slide 131 laterally to selectively position finger 140 within the locking space 84 of guide 7 to lock all drawers 3–5 closed.

In the event a center lock arrangement 154 is desired, the actuator rod 147 associated with the center key lock is inserted into aperture 146 of bracket 144, which serves to selectively shift slide 131 laterally between the locked and unlocked positions.

The illustrated vertical file 2 is extremely versatile, and can be used in many different environments. For example, vertical file 2 can be used either as a freestanding filing unit, or as a pedestal for a worksurface 160, as shown by the broken lines in FIG. 2. The compact construction of case 20, vertical stiffeners 27 and 28, and incorporation of interlock mechanism 1 therein, permits a standard sized case to accept either $8\frac{1}{2}\times 11$ or A4 size file drawers therein. Interlock mechanism 1 can be snap locked into case 20 at several different locations to accommodate various drawer configurations. The lock mechanism 130 can be easily snapped into place, or removed completely as desired, and can accommodate either a center lock configuration 154, or a drawer front configuration 155.

Drawer interlock 1 is extremely reliable, and is also flexible to readily adapt the same for use in conjunction with many different drawer configurations. The cam 11 and sliding block separator 116 of interlock mechanism 1 positively prevent more than one drawer from being opened at a time. The snap positioning feature achieved by engagement between cam wing 104 and rounded protrusion 56, as well as the vertical shifting motion of cam 11, assists in retaining each cam 11 in its set locked and unlocked positions, and thereby helps to prevent inadvertent movement therefrom. By positioning blocks 6 in a specially designed vertical stiffener 27, the available lateral space within case 20 is maximized for greater storage capacity.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. An interlock mechanism for furniture units and the like of the type having first and second drawers, comprising:

first and second actuator pins adapted for connection with the first and second drawers respectively, and translating generally horizontally therewith between closed and open positions;

a vertically extending guide positioned adjacent to said first and second actuator pins;

a plurality of blocking elements disposed directly on top of one another in a vertical stack and slideably mounted in said guide for vertical translation therein; each of said blocking elements having a top edge, and a ramp-shaped lower edge;

first and second block actuators associated with said first and second drawers respectively, and each including:

an arm having an upper portion thereof pivotally connected with said guide, and a lower portion thereof with a notch configured to selectively receive therein the actuator pin of an associated one of said first and second drawers, such that shifting said associated drawer between the closed and opened positions rotates said arm between corresponding unlocked and locked positions;

a wedge slidingly supported by said guide for generally horizontal reciprocation between unlocked and locked positions; said wedge, when in the unlocked position, being disposed alongside of and in horizontal alignment with the ramp-shaped bottom edge of a first one of said blocking elements, and the top edge of a second one of said blocking elements disposed vertically next adjacent thereto; said wedge being pivotally connected with the lower portion of said arm, such that rotation of said arm positively extends and positively retracts said wedge into and completely out of the vertical stack of said blocking elements;

said wedge being shaped such that rotation of said arm by opening of an associated one of the first and second drawers shifts said wedge into the locked position by inserting the same inbetween the ramp-shaped bottom edge of said first blocking element and the top edge of said second blocking element, thereby positively preventing vertical movement of each of said blocking elements disposed below said wedge, and vertically shifting each of those blocking elements disposed above said wedge so that their ramp-shaped bottom edge is out of horizontal alignment with the associated wedge to thereby prevent opening of the other one of the first and second drawers.

2. An interlock mechanism as set forth in claim 1, wherein:

said arm and said guide include oppositely facing, frictionally engaging positioner elements which assist in preventing said arm from being inadvertently shifted from its set unlocked and locked positions.

3. An interlock mechanism as set forth in claim 2, wherein:

said guide comprises a U-shaped upright adapted to vertically extend adjacent a forward portion of an associated furniture unit to stiffen the same, with a hollow interior in which said blocking elements are slidingly received.

4. An interlock mechanism as set forth in claim 3, wherein:

said positioner elements include a resilient wing protruding from a rearward edge of said arm; and a rounded protrusion extending outwardly of said guide, positioned to selectively abut said wing.

5. An interlock mechanism as set forth in claim 4, wherein:

said guide includes a plurality of horizontally extending slots shaped to slidingly receive and capture therein an associated wedge; said slots being positioned along said guide in a preselected pattern to accommodate drawers of different depths.

6. An interlock mechanism as set forth in claim 5, wherein:

said guide includes a plurality of elongated mounting apertures shaped to pivotally receive and capture therein the upper portion of an associated arm; said mounting apertures being positioned along said guide in a preselected pattern to accommodate drawers of different depths.

7. An interlock mechanism as set forth in claim 6, wherein:

said arm includes an outwardly projecting mounting pin with an enlarged head shaped to be received within a selected one of said mounting apertures; and said slots each include an interior window through which an associated one of said wedges can be inserted, so as to detachably mount said block actuators at various positions along said guide to accommodate drawers of different depths.

8. An interlock mechanism as set forth in claim 7, wherein:

said guide is shaped to define a lock space above said blocking elements; and including:

a lock actuator with means for shifting the same into and out of said lock space to simultaneously lock and unlock said first and second drawers.

9. An interlock mechanism as set forth in claim 8, wherein:

said arm includes a longitudinally extending, elongate aperture in the lower portion thereof; an said wedge includes an outwardly projection mounting pin with an enlarged head shaped to be received within the elongate aperture of said arm to detachably and pivotally interconnect the same.

10. An interlock mechanism as set forth in claim 1, wherein:

said guide comprises a U-shaped upright adapted to vertically extend adjacent a forward portion of an associated furniture unit to stiffen the same, with a hollow interior in which said blocking elements are slidingly received.

11. An interlock mechanism as set forth in claim 1, wherein said guide includes:

a plurality of horizontally extending slots shaped to slidingly receive and capture therein an associated wedge;

a plurality of elongated mounting apertures shaped to pivotally receive and capture therein the upper portion of an associated arm; and said slots and said mounting apertures being positioned along said guide in a preselected pattern to accommodate drawers of different depths 12. An interlock mechanism as set forth in claim 11, wherein:

said arm includes an outwardly projecting mounting pin with an enlarged head shaped to be received within a selected one of said mounting apertures; and said slots each include an interior window through which an associated one of said wedges can be inserted, so as to detachably mount said block actuators at various positions along said guide to accommodate drawers of different depths.

13. An interlock mechanism as set forth in claim 1, wherein:

said guide is shaped to define a lock space above said blocking elements; and including:

a lock actuator with means for shifting the same into and out of said lock space to simultaneously lock and unlock said first and second drawers.

14. In a furniture unit of the type having first and second drawers, an interlock mechanism therefor, comprising:

first and second actuator pins connected with said first and second drawers respectively, and translating generally horizontally therewith between closed and open positions;

a vertically extending guide mounted in said furniture unit adjacent to said first and second actuator pins;

a plurality of blocking elements disposed directly on top of one another in a vertical stack and slideably mounted in said guide for vertical translation therein; each of said blocking elements having a top edge, and a ramp-shaped lower edge;

first and second block actuator associated with said first and second drawers respectively, and each including:

an arm having an upper portion thereof pivotally connected with said guide, and a lower portion thereof with a notch configured to selectively receive therein the actuator pin of an associated one of said first and second drawers, such that shifting said associated drawer between the closed and opened positions rotates said arm between corresponding unlocked and locked positions;

a wedge slidingly supported by said guide for generally horizontal reciprocation between unlocked and locked positions; said wedge, when in the unlocked position, being positioned alongside of and in horizontal alignment with the ramp-shaped bottom edge of a first one of said blocking elements, and the top edge of a second one of said blocking elements disposed vertically next adjacent thereto; said wedge being pivotally connected with the lower portion of said arm, such that rotation of said arm positively extends and positively retracts said wedge into and completely out of the vertical stack of said blocking elements; said wedge being shaped such that rotation of said arm by opening of an associated one of said first and second drawers shifts said wedge into the locked position by inserting the same inbetween the ramp-shaped bottom edge of said first blocking element and the top edge of said second blocking element, thereby positively preventing vertical movement of each of said blocking elements disposed below said wedge, and vertically shifting each of those blocking elements disposed above said wedge so that their ramp-shaped bottom edge is out of horizontal alignment with the associated wedge to thereby prevent opening of the other one of said first and second drawers.

15. A furniture unit as set forth in claim 14, wherein:

said guide comprises a vertically extending, U-shaped upright positioned adjacent to a forward portion of said furniture unit to stiffen the same, with a hollow interior in which said blocking elements are slidingly received.

16. A furniture unit as set forth in claim 15, wherein:

said arm and said guide include oppositely facing, frictionally engaging positioner elements which assist in preventing said arm from being inadvertently shifted from its set unlocked and locked positions.

17. A furniture unit as set forth in claim 16, wherein:

said positioner elements include a resilient wing protruding from a rearward edge of said arm; and a rounded protrusion extending outwardly of said guide, positioned to selectively abut said wing.

18. A furniture unit as set forth in claim 17, wherein said guide includes:

a plurality of horizontally extending slots shaped to slidingly receive and capture therein an associated wedge;

a plurality of elongated mounting apertures shaped to pivotally receive and capture therein the upper portion of an associated arm; and said slots and said mounting apertures being positioned along said guide in a preselected pattern to accommodate drawers of different depths.

19. A furniture unit as set forth in claim 18, wherein:

said arm includes an outwardly projecting mounting pin with an enlarged head shaped to be received within a selected one of said mounting apertures; and said slots each include an interior window through which an associated one of said wedges can be inserted, so as to detachably mount said block actuators at various positions along said guide to accommodate drawers of different depths.

20. An interlock mechanism as set forth in claim 19, wherein:

said guide is shaped to define a lock space above said blocking elements; and including:

a lock actuator with means for shifting the same into and out of said lock space to simultaneously lock and unlock said first and second drawers.

21. A furniture unit, comprising:

a case having an exterior skin and at least one vertically extending stiffener channel connected therewith to define a guide slot therebetween;

first and second drawers slideably mounted in said case for horizontal movement between closed and open positions;

first and second actuator pins connected with said first and second drawers respectively for translation therewith, and positioned adjacent said guide slot when said drawers are int he closed position;

a plurality of blocking elements disposed directly on top of one another in a vertical stack and slideably mounted in said guide slot for vertical translation therein; each of said blocking elements having a top edge, and a lower edge;

first and second block actuators associated with said first and second drawers respectively, and each including:

an arm pivotally connected with said guide, and including a notch configured to selectively receive therein the actuator pin of an associated one of said first and second drawers, such that shifting said associated drawer between the closed and opened positions rotates said arm between corresponding unlocked and locked positions;

a wedge slidingly supported by said guide for generally horizontal reciprocation between unlocked and locked positions; said wedge, when in the unlocked position, being disposed alongside of and in horizontal alignment with the bottom edge of a first one of said blocking elements, and the top edge of a second one of said blocking elements disposed vertically next adjacent thereto; said wedge being operably connected with said arm, such that rotation of said arm positively extends the positively retracts said wedge into and completely extends and positively retracts said wedge into and completely out of the vertical stack of said blocking elements; said wedge being shaped such that rotation of said arm by opening of an associated one of said first and second drawers shifts said wedge into the locked position by inserting the same inbetween the bottom edge of said first blocking element and the top edge of said second blocking element, thereby positively preventing the opening of the other one of said first and second drawers.

22. An interlock mechanism as set forth in claim 21, wherein:

said arm and said guide include oppositely facing, frictionally engaging positioner elements which assist in preventing said arm from being inadvertently shifted from its set unlocked and locked positions.

23. An interlock mechanism as set forth in claim 22, wherein:

said positioner elements include a resilient wing protruding from a rearward edge of said arm; and a rounded protrusion extending outwardly of said guide, positioned to selectively abut said wing.

24. An interlock mechanism as set forth in claim 23, wherein said guide includes:

a plurality of horizontally extending slots shaped to slidingly receive and capture therein an associated wedge;

a plurality of elongated mounting apertures shaped to pivotally receive and capture therein the upper portion of an associated arm; and said slots and said mounting apertures being positioned along said guide in a preselected pattern to accommodate drawers of different depths.

25. An interlock mechanism as set forth in claim 24, wherein:

said arm includes an outwardly projecting mounting pin with an enlarged head shaped to be received within a selected one of said mounting apertures; and said slots each include an interior window through which an associated one of said wedges can be inserted, so as to readily mount said block actuators at various positions along said guide to accommodate drawers of different depths.

26. An interlock mechanism as set forth in claim 25, wherein:

said guide is shaped to define a lock space above said blocking elements; and including:

a lock actuator with means for shifting the same into and out of said lock space to simultaneously lock and unlock said first and second drawers.

27. An interlock actuator for multiple drawer furniture units of the type having vertically stacked blocking elements that are disposed directly on top of one another and selectively displaced to permit only one drawer to be opened at a time; said actuator comprising:

an arm having an upper portion thereof with an outwardly projecting mounting pin for pivotally mounting the same in the furniture unit, and a lower portion thereof with a notch configured to selectively receive therein an actuator pin of an associated drawer, such that shifting the drawer between closed and opened positions rotates said arm between corresponding unlocked and locked positions; and a wedge having upper and lower portions thereof shaped for slidingly mounting the same in the furniture unit for generally horizontal reciprocation between unlocked and locked positions; said wedge having an angled leading end shaped to be selectively inserted into the vertically stacked blocking elements for positively preventing vertical movement of each of said blocking elements disposed below said wedge, and vertically shifting each of those blocking elements disposed above said wedge so that they are out of horizontal alignment with the associated wedge to thereby prevent opening of another one of the drawers; said wedge being pivotally connected with the lower portion of said arm such that rotation of said arm positively extends and positively retracts said wedge into and completely out of the vertically stacked blocking elements.

28. An interlock actuator as set forth in claim 27, wherein:

said arm includes a resilient wing which assists in preventing said arm from being inadvertently shifted from its set unlocked and locked positions.

29. An interlock actuator as set forth in claim 27, wherein:

said arm mounting pin includes an enlarged head shaped to be received within an associated mounting aperture in the furniture unit.

30. An interlock actuator as set forth in claim 27, wherein:

said arm includes a longitudinally extending, elongate aperture in the lower portion thereof; and said wedge includes an outwardly projection mounting pin with an enlarged head shaped to be received within the elongate aperture of said arm to detachably and pivotally interconnect the same.

* * * * *

UNITED STATES PATENT AND TRADEMARK OFFICE

CERTIFICATE OF CORRECTION

PATENT NO. : 5,303,994

DATED : April 19, 1994

INVENTOR(S) : Michael D. Elsholz

It is certified that error appears in the above-indentified patent and that said Letters Patent is hereby corrected as shown below:

Column 1, line 37;

After "drawers" insert –.–.

Column 2, line 18;

After "drawers" insert –.–.

Column 2, line 37;

After "drawers" insert –.–.

Column 3, line 11;

After "opened" insert –.–.

Column 3, line 37;

After "contrary" insert –.–.

Column 3, line 42;

After "claims" insert –.–.

Column 3, line 66;

After "respectively" insert –.–.

UNITED STATES PATENT AND TRADEMARK OFFICE

CERTIFICATE OF CORRECTION

PATENT NO. : 5,303,994

DATED : April 19, 1994

INVENTOR(S) : Michael D. Elsholz

It is certified that error appears in the above-indentified patent and that said Letters Patent is hereby corrected as shown below:

Column 4, line 57;

"actuators pin" should be –actuator pins–.

Column 5, line 25;

After "7" insert –.–.

Column 5, line 42;

After "therein" insert –.–.

Column 5, line 51;

After "therebetween" insert –.–.

Column 7, line 23;

After "respectively" insert –.–.

Column 8, line 51;

After "security" insert –.–.

Column 12, claim 11, line 6;

After "depths" insert –.–.

UNITED STATES PATENT AND TRADEMARK OFFICE

CERTIFICATE OF CORRECTION

PATENT NO. : 5,303,994

DATED : April 19, 1994

INVENTOR(S) : Michael D. Elsholz

It is certified that error appears in the above-indentified patent and that said Letters Patent is hereby corrected as shown below:

Column 13, claim 21, line 67;

"int he" should be –in the–.

Column 14, claim 21, lines 25 and 26;

After "extends" delete –the positively retracts said wedge into and completely extends–.

Signed and Sealed this

Twenty-ninth Day of November, 1994

*Attest:*

Bruce Lehman

BRUCE LEHMAN

*Attesting Officer*

*Commissioner of Patents and Trademarks*